US006179581B1

(12) United States Patent
Schnittger et al.

(10) Patent No.: US 6,179,581 B1
(45) Date of Patent: Jan. 30, 2001

(54) PUMP CONNECTION TO DRIVE SHAFT

(75) Inventors: Karsten Schnittger, Bad Vilbel; Hans-Jürgen Lauth, Neu Anspach, both of (DE)

(73) Assignee: Luk Fahrzeug-Hydraulik GmbH & Co. KG (DE)

( * ) Notice: Under 35 U.S.C. 154(b), the term of this patent shall be extended for 0 days.

(21) Appl. No.: 09/219,658

(22) Filed: Dec. 23, 1998

(30) Foreign Application Priority Data

Dec. 23, 1997 (DE) ..... 197 57 439

(51) Int. Cl.[7] ..... F04B 17/00; F04B 35/00

(52) U.S. Cl. ..... 417/360; 417/302

(58) Field of Search ..... 123/41.47; 310/87; 417/76, 360, 53, 302, 40, 454, 423.1; 418/217, 135, 104; 464/29

(56) References Cited

U.S. PATENT DOCUMENTS

| | | | | |
|---|---|---|---|---|
| 3,744,942 | * | 7/1973 | Mount | 418/76 |
| 4,272,224 | * | 6/1981 | Kabele | 417/360 |
| 4,311,440 | * | 1/1982 | Eberhardt | 417/360 |
| 4,350,911 | * | 9/1982 | Wilson et al. | 310/87 |
| 4,473,342 | * | 9/1984 | Iles | 417/360 |
| 4,530,313 | * | 7/1985 | Zaremba | 123/41.47 |
| 4,547,131 | * | 10/1985 | Riffe et al. | 417/53 |
| 4,575,324 | * | 3/1986 | Sommer et al. | 418/217 |
| 4,743,177 | * | 5/1988 | Ozu et al. | 417/360 |
| 4,854,829 | * | 8/1989 | Stanzani et al. | 417/360 |
| 4,898,518 | * | 2/1990 | Hubbard et al. | 417/360 |
| 4,904,166 | * | 2/1990 | Wasemann | 417/360 |
| 5,045,026 | * | 9/1991 | Buse | 464/29 |
| 5,076,762 | * | 12/1991 | Lykes et al. | 417/40 |
| 5,096,392 | * | 3/1992 | Griebel et al. | 417/454 |
| 5,399,075 | * | 3/1995 | Frank et al. | 417/423.1 |
| 5,807,090 | * | 9/1998 | Agner | 418/135 |
| 5,980,225 | * | 11/1999 | Sommer | 418/104 |
| 6,033,190 | * | 3/2000 | Merz | 417/302 |

FOREIGN PATENT DOCUMENTS

| | | |
|---|---|---|
| 41010117A1 | 7/1991 | (DE) . |
| 0699435 | 11/1953 | (GB) . |
| 1165465 | 10/1969 | (GB) . |
| 1200369 | 7/1970 | (GB) . |
| 2017865 | 10/1979 | (GB) . |
| 2118259 | 10/1983 | (GB) . |
| 2136054 | 9/1984 | (GB) . |
| 2234321 | 1/1991 | (GB) . |
| 2240590 | 8/1991 | (GB) . |
| 2255377 | 11/1992 | (GB) . |

* cited by examiner

*Primary Examiner*—Teresa Walberg
*Assistant Examiner*—Leonid Fastovsky
(74) *Attorney, Agent, or Firm*—Ostrolenk, Faber, Gerb & Soffen, LLP

(57) ABSTRACT

A pump having a pump housing with a rotor in it, particularly a vane pump. The pump housing having a centering aid in the form of a sleeve that extends toward a drive shaft. The shaft has a smaller diameter than the bore through the sleeve. The shaft has a preferably toothed end portion that is received in a non-positively locking manner in the rotor. In a single stroke vane pump, the axis of the drive shaft is offset from the axis of the sleeve to compensate for the forces in pumping. The housing over the rotor and drive thereto is disclosed.

20 Claims, 4 Drawing Sheets

PUMP CONNECTION TO DRIVE SHAFT

BACKGROUND OF THE INVENTION

The invention relates to a pump with a rotor, having a bore for receiving a drive shaft with positive locking and which is arranged inside a pump housing, wherein the pump housing comprises a cup-shaped housing part and a further housing part which is provided with a through bore. The invention additionally relates to a pump device with a pump which comprises a rotor having a bore, and relates to a drive device with a drive shaft for driving the pump.

Known pumps of this type are designed, for example, in the form of vane-type pumps or gear pumps and are used for conveying gaseous or liquid substances.

To drive the rotor, the pump is provided with a pump shaft which is coupled by a coupling to a drive shaft, for example, a motor shaft. The pump shaft is held rotatably inside the pump housing with the aid of bearings. The bearings require space in the pump housing, and this prevents a reduction in the size of the pump housing. Furthermore, additional assembly steps are necessary for fitting the bearings.

SUMMARY OF THE INVENTION

The object of the invention is to provide a pump device which is small in size and which is inexpensive to produce and assemble.

This object is attained by a pump including a pump housing, a pump rotor in the housing, a cup-shaped housing part over the rotor and a novel connection between the rotor and a drive shaft. The further housing part of the pump is provided with a centering aid which pre-centers the drive shaft with respect to the housing part during assembly to ensure simple and reliable assembly of the drive unit and the pump so as to form a pump device.

The centering aid is constructed like a sleeve and is in alignment with a through bore passing through the centering aid. The internal diameter of the centering aid exceeds the external diameter of the drive shaft defining a gap between the through bore and the drive shaft. This ensures that during pumping, i.e. while the drive shaft is rotating, unnecessary friction loss does not occur between an outer wall of the drive shaft and an inner wall of the sleeve shaped insertion aid.

In addition, the centering aid has a longitudinal sealing portion which is adjacent to the rotor and which is provided with at least one seal. The seal is attached concentrically immediately adjacent to the rotor to ensure that the conveyed medium cannot escape in the direction of the drive unit along the drive axis and also so that undesired particles or substances cannot penetrate into the interior of the pump in the opposite direction.

In a preferred embodiment, the centering aid has a longitudinal centering portion which is remote from the rotor and which has axial length which exceeds the axial length of the longitudinal end portion of the drive shaft that is used for the positively locking connection. This ensures that when the drive shaft is inserted in the centering aid, the longitudinal end portion of the drive shaft which is used for the positively locking connection, can engage, pre-centered by the through bore, in the bore in the rotor and thus cannot damage or destroy the seal. This makes it possible to insert the drive shaft into the rotor of the pump without jamming and thus to assemble the pump device without errors.

Further, a first housing part, which is over a second housing part, comprises a centering pin which is in alignment with the longitudinal axis of the rotor and which has a smaller external diameter than the internal diameter of the bore in the rotor. The centering pin is securely mounted on the first housing part, so that the first housing part cannot jointly rotate with the rotor. In the unassembled state, i.e. without the drive shaft or without the drive unit, the rotor is held by the centering pin substantially in the center of the first pump housing, so that the drive shaft can safely engage in the rotor when inserted into the pump. Since the rotor is situated precisely centrally in the rotor housing after the assembly of the rotor, and since the external diameter of the centering pin is smaller than the internal diameter of the rotor bore, there is no unnecessary friction between the rotor and the centering pin after the drive shaft has been completely inserted in the rotor.

As an additional feature, the bore in the rotor has an internal set of teeth which cooperates with an external set of teeth on the drive shaft. The external set of teeth on the drive shaft is provided on the positively locking longitudinal portion of the drive shaft, as explained above. The set of teeth is used for transmitting force from a drive to the pump rotor and should thus be dimensioned such that the driving moment can be transmitted without slippage.

In a further preferred embodiment, the pump is a single-stroke vane-type pump. In the rest position of this pump, its rotor is arranged eccentrically to components of a pump housing forming the pump chamber. This advantageously makes it possible for force acting radially upon one side of a drive shaft of the pump, because of the single-stroke design of the pump, to center the rotor. This ensures that the rotor runs centered even if the drive shaft is bent at the operating point of the single-stroke vane-type pump. In particular, this reduces noise and wear and improves efficiency.

In particular, it is preferred if a longitudinal axis of a drive shaft has an offset with respect to a longitudinal axis of the pump. That offset preferably corresponds in its size and direction to the bending of the drive shaft at the operating point of the single-stroke vane-type pump. This makes it possible to compensate for the bending of the drive shaft.

In the pump of the invention, a drive shaft engages in the bore in the rotor with positive locking, so that the pump itself is not provided with its own pump shaft. This pump device has the advantage that by reducing the number of components required, the weight of the pump is lower than that of a conventional pump, and more compact and smaller dimensions are achieved.

A further advantage of the invention is afforded by dispensing with the structural groups of the mounting and the coupling which are susceptible to wear. This increases the wear resistance of the pump device, in particular for pumps supplying diesel fuel, since on account of its low viscosity, diesel fuel is unsuitable as a lubricant.

Other objects and features of the invention are described in an embodiment described below with reference to the drawings.

DESCRIPTION OF PREFERRED EMBODIMENTS

Figure 1:
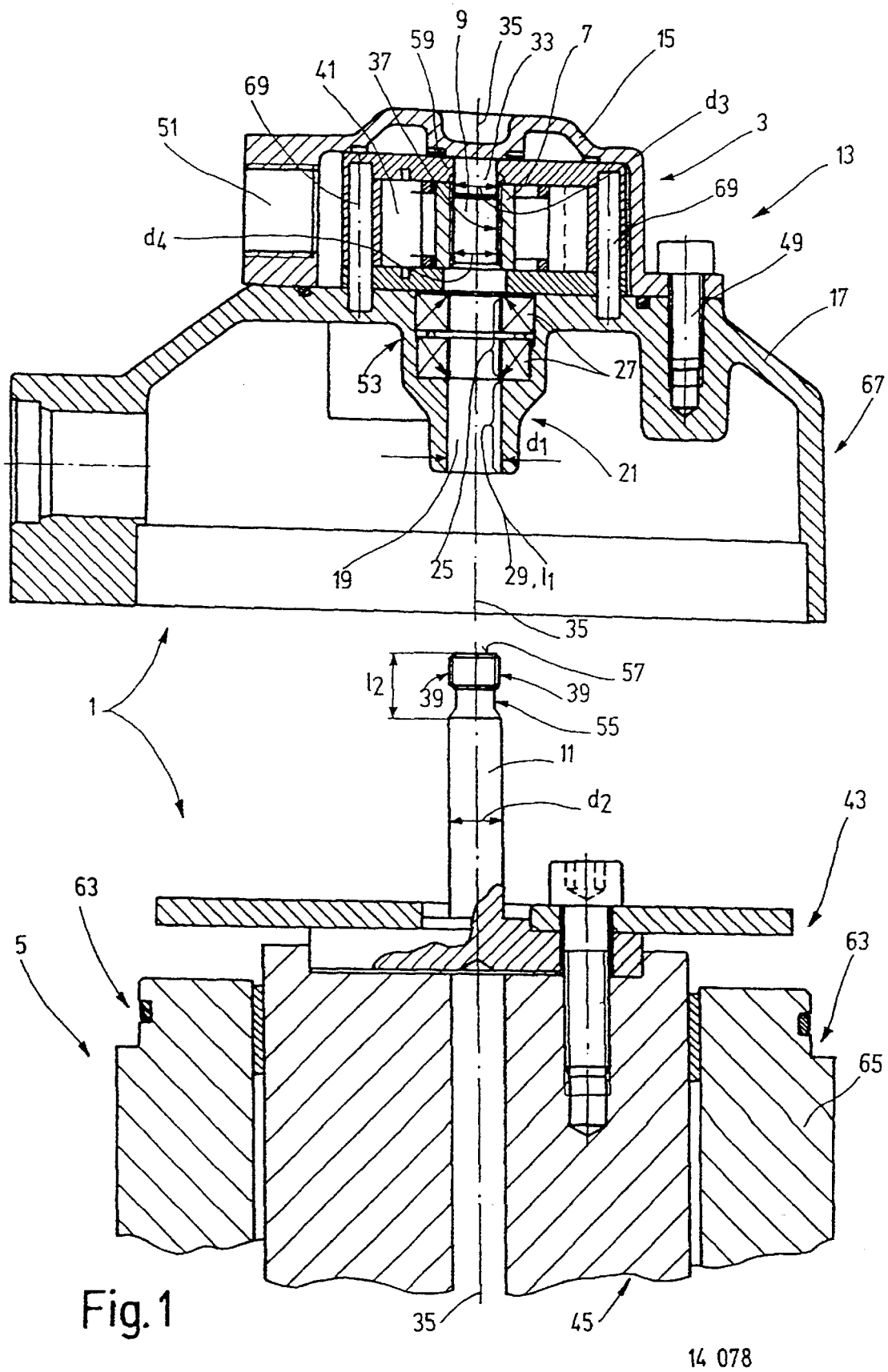
FIG. 1 is a cross-sectional view of a pump device according to the invention in an unassembled state.

The cross-sectional illustration of FIG. 1 shows a pump device 1 for supplying diesel fuel, for example, in a motor vehicle, from a storage tank to a combustion chamber of an internal-combustion engine. The pump device 1, comprises a vane-type pump 3 and a drive device 43, or an accessory 45 respectively, which acts as a drive motor, referred to simply as the motor 5. These are shown in an unassembled state in FIG. 1. This means that the vane-type pump, referred to simply as the pump 3, and the motor 5 are not joined mechanically. The term "drive device 43", is intended to cover all variants of a drive which occur in conjunction with a motor vehicle. The pump device 1 can thus be driven by the drive shaft of the internal-combustion engine, by its camshaft and also for example by a so-called drive-through shaft of an air compressor, as used for example in conjunction with the braking system of a truck. It is also possible, however, to use a separate electric motor to drive the pump device. It is assumed below that the motor 5 is used for the drive.

The pump 3 in turn is provided essentially with a two-part pump housing 13, including a cup-shaped housing part 15 attached flush on the outside to a, larger shell-shaped housing part 17, and the pump 3 further includes a rotor 7 with vanes 41 which can be displaced radially outwards as in a standard vane pump.

The two housing parts 15 and 17 of the pump 3 are connected together by the bolts 49. In the sectional illustration of FIG. 1, however, only one bolt 49 is shown. In addition, for improved centering of the rotary group comprising the rotor 7 with respect to the two housing halves 15 and 17, a plurality (two in the sectional illustration) of guide pins 69 are provided which extend at right angles to a contact face between the two housing parts 15 and 17, and the pins 69 are inserted into the housing part 17 and into the rotary group.

The pump 3 is a fuel-supply pump (pre-supply pump) which has an inlet and an outlet opening 51 in order to draw the diesel fuel out of the storage tank on the one hand and to supply it to an injection pump on the other hand in accordance with the known principles of a vane-type pump 3. A detailed description of the mounting of the vanes 41 on the rotor 7 is not provided since this is not relevant to the invention. Further, other pump principles, for example, roller-cell pumps or radial-piston pumps, can also be used.

Viewed centrally in the interior of the shell in the illustration, housing part 17 is provided with a centering aid 21, which in this case is sleeve-shaped and which extends in the direction of a rotational or longitudinal axis 35 and which in this case is formed in one piece with the second housing part. A through bore 19 extends in the axial direction through the centering aid 21. In the embodiment illustrated, the outer diameter of the centering aid 21 tapers inwards in the direction of the "shell opening", so that on the attachment 53 of the "shell base", the centering aid has a greater wall thickness than at the opposite end, i.e. in the "shell opening" direction. The wall thickness of the centering aid 21, however, is of secondary importance for its operation. In the region of the attachment 53, two axially adjacent seals 27 are fitted in a longitudinal sealing portion 25 inside the centering aid 21. It is also possible, however, for only one or even for more seals 27 to be fitted in the center aid 21. The further axial longitudinal portion of the centering aid 21 remote from the attachment 53 is referred to below as the longitudinal centering portion 29 and is used for pre-centering a drive shaft 11 of a drive device 43.

In FIG. 1, the drive shaft 11 includes an undercutting 55 located close to its free end projecting out of the drive unit. The area between the undercutting 55 and the end face 57 of the drive shaft 11 has an external set of teeth 39 for a positively locking connection with the rotor 7. An internal set of teeth 37 is provided in a corresponding manner on an inner wall of a central bore 9 formed in the rotor 7, so that the internal set of teeth 37 of the rotor 7 and the external set of teeth 39 of the drive device 43 can form a positively locking connection 31.

The centering aid 21 has an internal diameter $d_1$ which is slightly larger than an external diameter $d_2$ of the drive shaft 11, producing a small gap 23 (FIG. 3) between the centering aid 21 and the drive shaft 11 in the assembled state, and preventing unnecessary friction loss during operation.

It is important that the length $\mathbf{1}_l$, as viewed in the axial direction, of the longitudinal centering portion 29 of the centering aid 21 be greater than an axial length $l_2$ which is indicated as the end of the drive shaft in FIG. 1. That end of the shaft is comprised of the axial longitudinal portion of the external set of teeth 39 plus the axial longitudinal portion of the undercutting 55 of the drive shaft 11. This length arrangement ensures that during the assembly of the pump device 1, the external set of teeth 39 and the undercutting and in particular also an area adjoining the portions of the drive shaft 11 are safely guided by the longitudinal centering portion 29.

Figure 3:
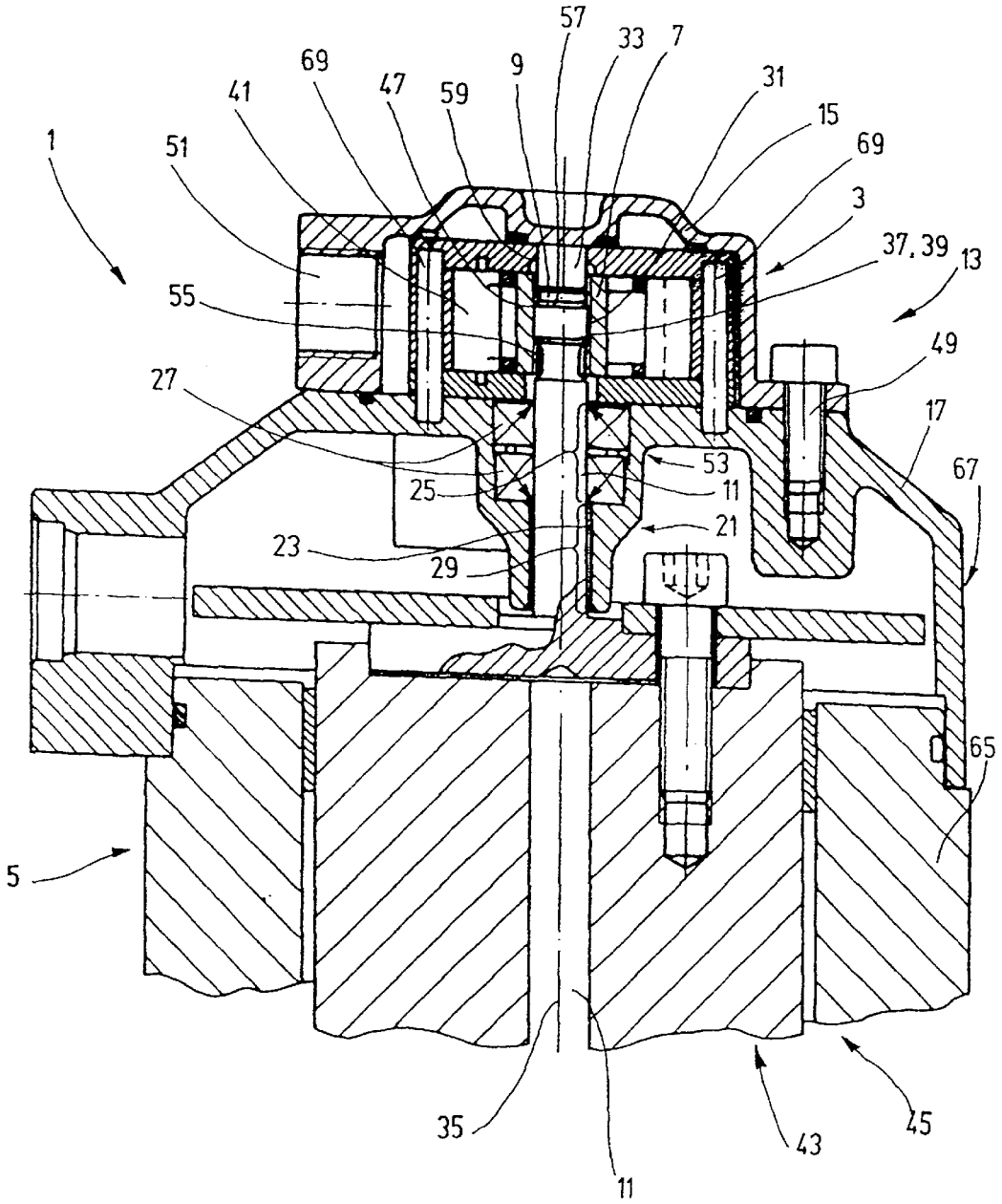
FIG. 3 is a cross-sectional view of the pump device illustrated in FIG. 1 in the assembled state.

The pump housing 13 additionally has a centering pin 33 oriented axially and centrally with the longitudinal axis 35. The centering pin 33 is secured rotationally rigidly inside the first housing part 15, preferably on an inner wall 59 of the housing, and projects in part into the bore 9 in the rotor 7. This means that the centering pin 33 does not completely fill the space of the bore 9, but penetrates therein only so far that the end of the drive shaft 11 can be inserted into the opposite opening of the bore for the positively locking connection 31 (FIG. 3). The centering pin 33 has an external diameter $d_3$ which is slightly smaller than an internal diameter $d_4$ of the rotor bore 9. Housing part 15 is also centered with respect to housing part 17 by the centering pin 33, since the centering pin 33 engages in the rotor of the rotor group, and the rotor group is centered with respect to housing part 17 by centering pins.

Figure 2:
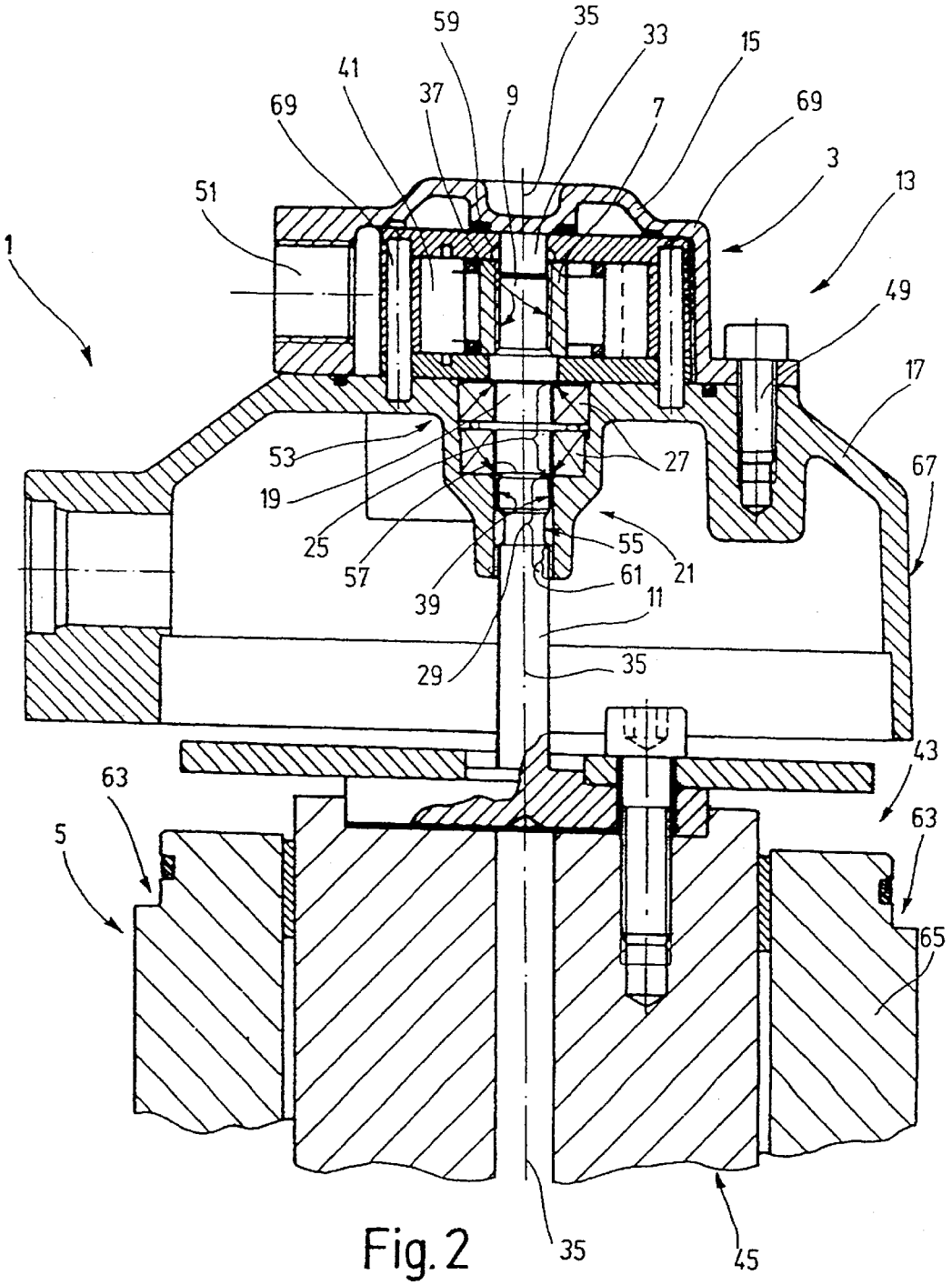
FIG. 2 is a cross-sectional view of the pump device illustrated in FIG. 1 in a partially assembled state.

The cross-sectional illustration of the pump device 1 in FIG. 2 shows the pump device 1 in a partly assembled state, i.e. the pump 3 and the motor 5 are completely assembled in themselves, but the pump and the motor are not yet completely joined together. In FIG. 2 the same reference signs are used as in FIG. 1, but for clarity, the internal and external diameters $d_1$ to $d_4$ and the lengths $l_1$ to $l_2$ are not reproduced in FIG. 2.

In FIG. 2, the drive shaft 11 is inserted so far into the through bore 19 in the centering aid 21 that the end face 57 of the drive shaft 11 just reaches the longitudinal sealing portion 25. Because the axial length $l_1$ of the longitudinal centering portion is greater than the axial length $l_2$ of the external set of teeth 39, this ensures that the drive shaft 11 is precisely centered by a guide in a region 61, i.e. before the external set of teeth 39 reaches the seals 27. In addition, if the drive shaft 11 is inserted further, the seals 27 and the rotor 7 are reliably prevented from being caught up or damaged. Upon further insertion of the drive shaft 11, the centering pin 33 ensures that the rotor 7, which is not in fact provided with its own mounting, is pre-centered such that the drive shaft 11 can be inserted into the rotor bore 9 without complications and/or damage.

FIG. 3 shows the pump device 1 in an assembled cross-sectional illustration, with the pump 3 and the motor 5 joined together. It is clear from FIG. 3 that the internal set of teeth 37 in the rotor and the external set of teeth 39 on the shaft 11 engage with each other in the axial center of the rotor 7 so as to produce a positively locking connection 31. The rotor 7 is now centered so precisely by the drive shaft 11 that the centering pin 33 no longer touches the rotor 7 and the pump 3 can be driven by the motor 5.

Note that the drive device 43 has a step 63 (FIG. 1) open at the edge on a motor-housing cover 65 directed towards the vane-type pump 3. The step 63 acts as a stop for housing part 17 of the pump 3 and thus prevents the drive shaft 11 from being inserted too far into the rotor bore 9. This ensures that a gap 47 remains between the end faces 57 of the drive shaft 11 and the centering pin 33, so no friction loss will occur at this point.

The shell-shaped design of housing part 17 forms the stop, as described above, and in addition serves as a housing cover 67 for the end face of the motor 5, so as to achieve a compact structural shape of the pump device 1. At the same time, this can be produced inexpensively by dispensing with mounting of the drive shaft 11 inside the pump. It is clear, therefore, that the rotary group need not have its own bearing associated with it.

In addition, fixing the above-mentioned diameters $d_1$, and $d_2$ ensures a gap, so as to provide easy assembly by simple centering of the parts joined together and at the same prevents loss of friction in longitudinal centering portions 29.

Figure 4:
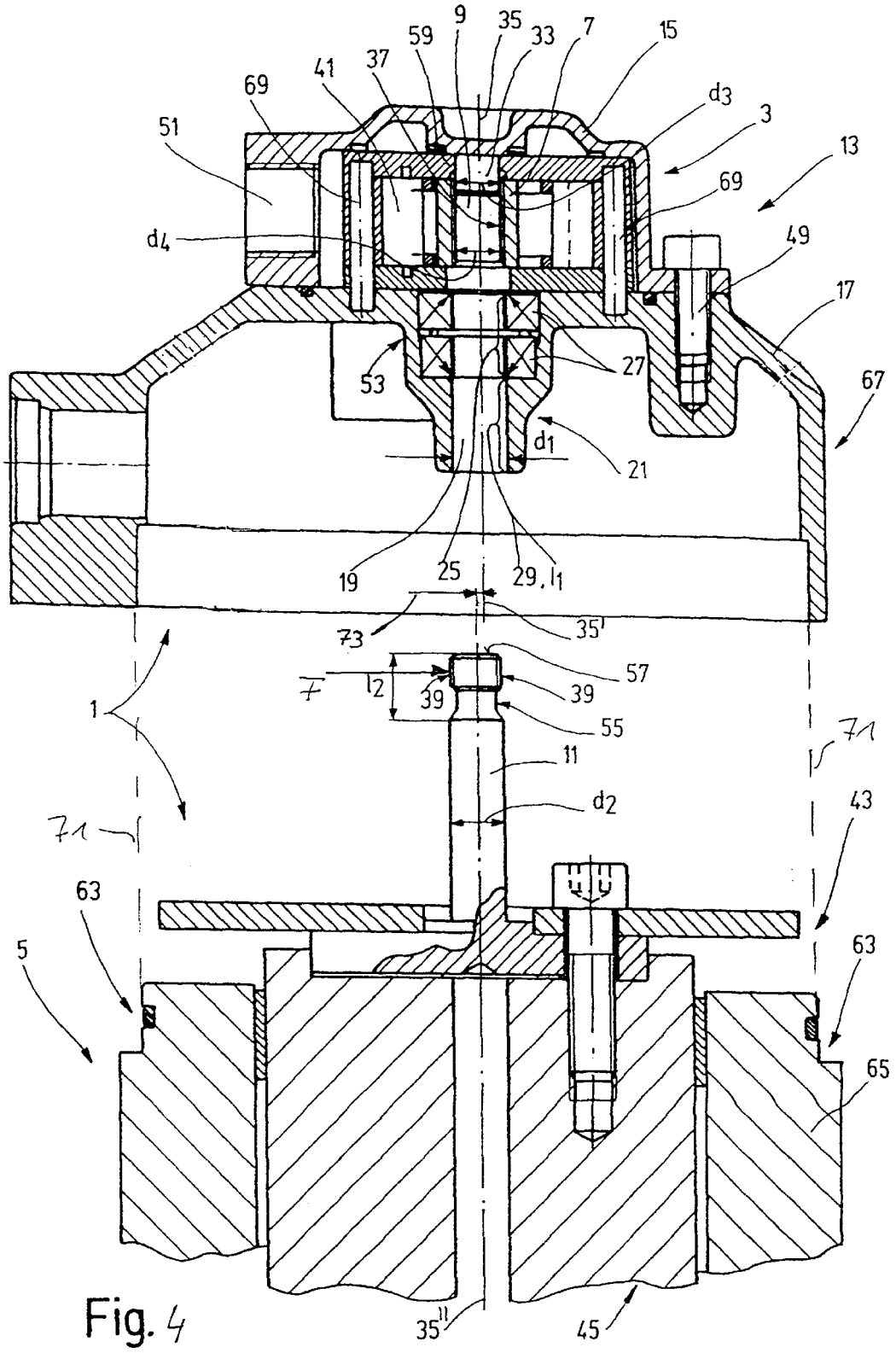
FIG. 4 is a cross-sectional view of a variant embodiment of a pump device in an unassembled state.

FIG. 4 shows a further variant embodiment of a pump device, in which the same parts as in FIGS. 1 to 3 are provided with the same reference signs and are not explained again. Only the differences are explained below.

In the embodiment in FIG. 4, it is assumed that a single-stroke vane-type pump is involved. Such pumps have the problem that pressure builds up at the operating point of the vane-type pump in the pressure compartment, and the pressure acts radially upon one side of the drive shaft 11. The drive shaft 11 is thus acted upon by a radial force, indicated for assistance as F in FIG. 4. It is clear that the force F can occur only when the pump 3 is assembled and in operation. This minimally deflects the drive shaft 11, causing the rotor 7 to be likewise slightly displaced radially, whereby the rotor is no longer situated in a centered manner with respect to the other components of the pump 3. This increases the risk of noise generation and causes increased wear and loss of efficiency. In order to eliminate these drawbacks the following provisions are made:

As shown in FIG. 4 by broken lines 71, the housing part 17 is oriented in alignment with the motor-housing cover 65, so that the pump 3 can be joined to the motor 5 as discussed in relation to FIGS. 2 and 3. At the same time, there is an offset 73 between the longitudinal axis 35" of the drive shaft 11 and a longitudinal axis 35' through the pump 3. The offset 73 produces an eccentric arrangement of the drive shaft 11 with respect to the pump 3.

During the assembly of the pump device, the offset 73 makes it possible for the rotor 7, which is mounted on the drive shaft 11 with a positive and non-positive locking connection, to be arranged eccentrically by the amount of the offset 73 with respect to the other components of the pump 3, in particular, the housing components receiving the rotor 7, such as the lifting ring and the side plates. To ensure that the pump device 1 is assembled despite the formation of the offset 73 between the longitudinal axes 35" and 35' respectively, the difference between the diameters $d_1$, and $d_2$, shown by gap 23 in FIG. 3, is selected so that there is sufficient play to permit assembly. At the same time, the at least one seal 27 is formed in such a way that the drive shaft 11 is received in the pump 3 in a sealed manner.

The offset 73 makes it possible for the rotor 7 to be arranged centrally with respect to the drive shaft 11 and eccentrically with respect to the other components of the pump 3 in the initial state of the pump device 1. During the operation of the pump device 1, which is constructed in the form of a single-stroke vane-type pump, the drive shaft 11 is acted upon radially in accordance with the pressure accumulating in the pressure compartment. The drive shaft 11 is acted upon radially with the force F, so that it becomes bent. The formation of the offset 73 between the longitudinal axis 35" and the longitudinal axis 35' is now selected such that the offset 73 corresponds in its size and direction to the bending of the drive shaft 11 at the operating point of the single-stroke vane-type pump. This compensates for the bending of the drive shaft 11, so that at the operating point of the single-stroke vane-type pump, the rotor 7 is centered with respect to the other components of the pump 3. Drawbacks associated with the bending of the drive shaft 11, in particular noise generation, wear, loss of efficiency, or the like, are thus eliminated. Depending upon the structural size of the single-stroke vane-type pump (the pump 3) the size of the offset 73 amounts for example to between 0.05 mm and 0.2 mm. In this case the longitudinal axis 35' is displaced in such a way with respect to the longitudinal axis 35" that between the arrangement of the pressure compartment and the direction of the offset 73 for example an angle range of between 170° and 190°, as viewed over the periphery of the rotor 7, is observed, i.e. they are effectively opposite.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A pump comprising:

a pump housing;

a pump mechanism including a rotor mounted in the housing, the rotor being rotatable to effect pumping; and a drive shaft for driving the rotor, the pump housing including a first housing part having a through-bore extending toward the drive shaft, and a centering aid comprised of a sleeve extending from the first housing part toward the drive shaft, the sleeve including a bore therein communicating with the through-bore, the bore in the sleeve being operative to receive and center the drive shaft with respect to the first housing part while the drive shaft is being inserted during assembly through the centering aid and the through-bore, the bore having an internal diameter which sufficiently exceeds the external diameter of the drive shaft to provide a radial clearance between the drive shaft and the centering aid when the pump is assembled.

2. The pump of claim 1, wherein:

the rotor includes a bore which receives one end of the drive shaft; and the end of the drive shaft which extends into the bore in the rotor cooperates with the inner surface of the bore to provide a positive locking connection between the drive shaft and the rotor.

3. The pump of claim 2, further including a motor coupled to the drive shaft.

4. A pump comprising:

a pump housing;

a pump mechanism including a rotor positioned in the housing, the rotor being rotatable to effect pumping;

a drive mechanism including a drive shaft for driving the rotor;

the pump housing including a first part having an inner and an outer wall defining a cavity open at a first end, and having a through-bore at an opposite second end through which the drive shaft extends; and a cup-shaped second housing part attached to the outer wall of the first housing part at the second end, and positioned to enclose the through-bore, thereby forming a chamber which houses the pumping mechanism, the drive shaft extending from the first housing part into the chamber through the through-bore when the pump is assembled to engage with the rotor in a driving relationship, the drive shaft being so positioned that it is not restrained radially or axially by the pump housing, a first centering aid within the first housing part including an opening communicating with the through-bore, the opening in the centering aid being operative to center the drive shaft with respect to the first housing part as the drive shaft is being inserted into the through-bore during assembly, the opening in the centering aid being sufficiently larger than the diameter of the drive shaft to provide a first radial clearance between the drive shaft and the centering aid when the pump is assembled.

5. The pump of claim 4, wherein the rotor includes an axially extending bore within which one end of the drive shaft is received when the pump is assembled, and further including:

a second centering aid comprised of a pin mounted on the inside of the chamber formed by the second housing part, the pin being axially aligned with the through-bore and extending into the bore in the rotor when the pump is assembled.

6. The pump of claim 5, wherein:

the ends of the drive shaft and the pin which extend into the bore in the rotor being separated by an axial gap when the pump is assembled;

the internal diameter of the bore in the rotor being sufficiently larger than the diameter of the pin to provide a second radial clearance between the pin and bore in the rotor when the pump is assembled.

7. The pump of claim 5 wherein:

the rotor includes a plurality of teeth projecting radially from the inner surface of the bore therein; and the drive shaft includes a plurality of teeth projecting radially outward from the surface thereof, the teeth on the rotor engaging with the teeth on the drive shaft when the pump is assembled to provide a positive locking connection between the rotor and the drive shaft.

8. The pump of claim 4 wherein the drive mechanism is attached to the first end of the first housing part.

9. The pump of claim 4 wherein the first housing part forms a cavity extending axially relative to the drive shaft, the cavity being open at the first end of the first housing part and having the through-bore at the axially opposite end, and wherein the drive mechanism includes a motor mounted within the cavity.

10. The pump of claim 1, wherein:

the pump housing is further comprised of a cup shaped second housing part;

the rotor is positioned within the second housing part; and the first housing part is disposed beneath the rotor.

11. The pump of claim 1, further comprising a longitudinal sealing portion in the sleeve of the centering aid adjacent the rotor, the sealing portion comprising at least one seal for sealing to the driving shaft passing through the centering aid.

12. The pump of claim 11, further comprising a longitudinal centering portion in the centering aid spaced away from the rotor, the longitudinal centering portion having a first axial length; and wherein the drive shaft includes an end portion which provides a positive locking connection with the rotor, the end portion of the drive shaft having a second axial length which is less than the first axial length of the longitudinal centering portion of the centering aid.

13. The pump of claim 1, further comprising a longitudinal centering portion in the centering aid spaced away from the rotor, the longitudinal centering portion having a first axial length; and wherein the drive shaft includes an end portion which provides a positive locking connection with the rotor, the end portion of the drive shaft having a second axial length which is less than the first axial length of the longitudinal centering portion of the centering aid.

14. The pump of claim 10, wherein:

the second housing part includes a centering pin aligned with the longitudinal axis of the rotor, the centering pin being located on the axial side of the rotor away from the centering aid and extending into the bore of the rotor a distance so as to be spaced away from the end of the drive shaft when the drive shaft is positioned in the rotor, the centering pin having an external diameter which is smaller than the internal diameter of the bore in the rotor.

15. The pump of claim 12, wherein:

the bore in the rotor includes an internal set of teeth; and the drive shaft end portion includes an external set of teeth shaped to cooperate with the internal set of teeth of the rotor to provide a driving connection for the rotor.

16. The pump of claim 1, wherein the pump mechanism comprises a vane type pump.

17. The pump of claim 1, wherein:

the pump mechanism comprises a single stroke vane type pump;

the drive shaft has a first longitudinal axis;

the centering aid has a second longitudinal axis; and the first longitudinal axis of the drive shaft is offset with respect to the second longitudinal axis of the centering aid to compensate for force applied to the rotor when the single stroke vane type pump is in operation.

18. The pump of claim 3, wherein the first housing part encloses the motor.

19. The pump of claim 18, further including a generally cup shaped second housing portion including a wall defining the cup shape, the wall of the housing enclosing a portion of the drive shaft.

20. The pump of claim 18, wherein the pump mechanism a single stroke vane type pump;

the drive shaft has a first longitudinal axis, the pump housing has a second longitudinal axis, and the first longitudinal axis of the drive shaft is offset with respect to the second longitudinal axis of the pump housing to compensate for force applied to the rotor when the single stroke vane type pump is in operation.

* * * * *